US006676114B2

(12) United States Patent
Gerhardy

(10) Patent No.: US 6,676,114 B2
(45) Date of Patent: Jan. 13, 2004

(54) CARBURETOR ARRANGEMENT HAVING AN ACCELERATOR PUMP

(75) Inventor: Reinhard Gerhardy, Korb (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 10/131,723

(22) Filed: Apr. 23, 2002

(65) Prior Publication Data

US 2002/0163087 A1 Nov. 7, 2002

(30) Foreign Application Priority Data

May 5, 2001 (DE) ..... 201 07 670

(51) Int. Cl.[7] ..... F02M 7/08
(52) U.S. Cl. ..... 261/34.2; 261/35
(58) Field of Search ..... 261/34.2, 35, 69.1, 261/69.2, DIG. 68

(56) References Cited

U.S. PATENT DOCUMENTS 3,575,388 A * 4/1971 Scarr ..... 261/34.2
5,250,233 A * 10/1993 Swanson ..... 261/34.2
6,234,458 B1 * 5/2001 Gerhardy ..... 261/71
6,293,524 B1 * 9/2001 Endo et al. ..... 261/34.2
6,354,571 B1 * 3/2002 Gerhardy ..... 261/35

* cited by examiner

*Primary Examiner*—Richard L. Chiesa
(74) *Attorney, Agent, or Firm*—R W Becker & Associates; R W Becker

(57) ABSTRACT

A carburetor arrangement is provided for an internal combustion engine of a manually guided implement, and includes a carburetor that is embodied in particular as a diaphragm carburetor. A butterfly valve is pivotably mounted in an air channel that is disposed in the carburetor and leads to the internal combustion engine. Also provided is an accelerator pump that includes a pump chamber and an accelerator piston that is guided in the pump chamber. The accelerator piston is coupled with the butterfly valve. The pump chamber can be connected with a fuel tank via a pump line. A first pressure-controlled check valve is provided in the pump line.

13 Claims, 2 Drawing Sheets

CARBURETOR ARRANGEMENT HAVING AN ACCELERATOR PUMP

BACKGROUND OF THE INVENTION

The present invention relates to a carburetor arrangement for an internal combustion engine of a manually guided implement, and includes a carburetor that is in particular embodied as a diaphragm carburetor.

Manually-guided implements such as power chain saws, brush cutters, trimmers, vacuum or blower devices, or the like are provided with a carburetor for producing a fuel/air mixture. For this purpose, a number of fuel nozzles are provided in an air channel of the carburetor that leads to the internal combustion engine; fuel enters the air channel through the fuel nozzles. The fuel nozzles, generally a main nozzle and an idling nozzle, are dimensioned with respect to their flow volume such that in an at least approximately steady operation of the internal combustion engine, a fuel/air mixture results having a desired fuel/air ratio. During the sudden opening of a butterfly valve that is provided for controlling the power, there often occurs a leaner mixture, which prevents a powerful acceleration of the internal combustion engine.

To compensate for the so-called acceleration deficit as a consequence of the leaner mixture, carburetor arrangements are known that have an accelerator pump. By means of the accelerator pump, during the rapid opening of the butterfly valve an additional quantity of fuel is injected into the air channel, thereby temporarily increasing the fuel portion in the fuel/air mixture. Known accelerator pumps comprise an accelerator piston that is guided in a pump chamber, is movably coupled with the butterfly valve, and during the opening of the butterfly valve conveys into the air channel a quantity of fuel that was stored in the pump chamber. The filling of the pump chamber with fuel is effected via a pump line, the opening of which into the pump chamber is partially opened, or closed, via the operating path of the accelerator piston. In this connection, the accelerator piston operates as a path-controlled feed valve. Such an arrangement leads to a relatively low intake and hence supply quantity of fuel per pump process relative to the volume of the pump chamber. Thus, the accelerator pump must be made appropriately large. For the opening and closing of the opening-out of the pump line, a dead path of the accelerator piston is necessary, as a consequence of which the accelerator injection process commences only after a time delay, i.e. after a certain opening angle of the butterfly valve.

It is therefore an object of the present invention to provide a carburetor arrangement, the accelerator pump of which has an improved effect.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
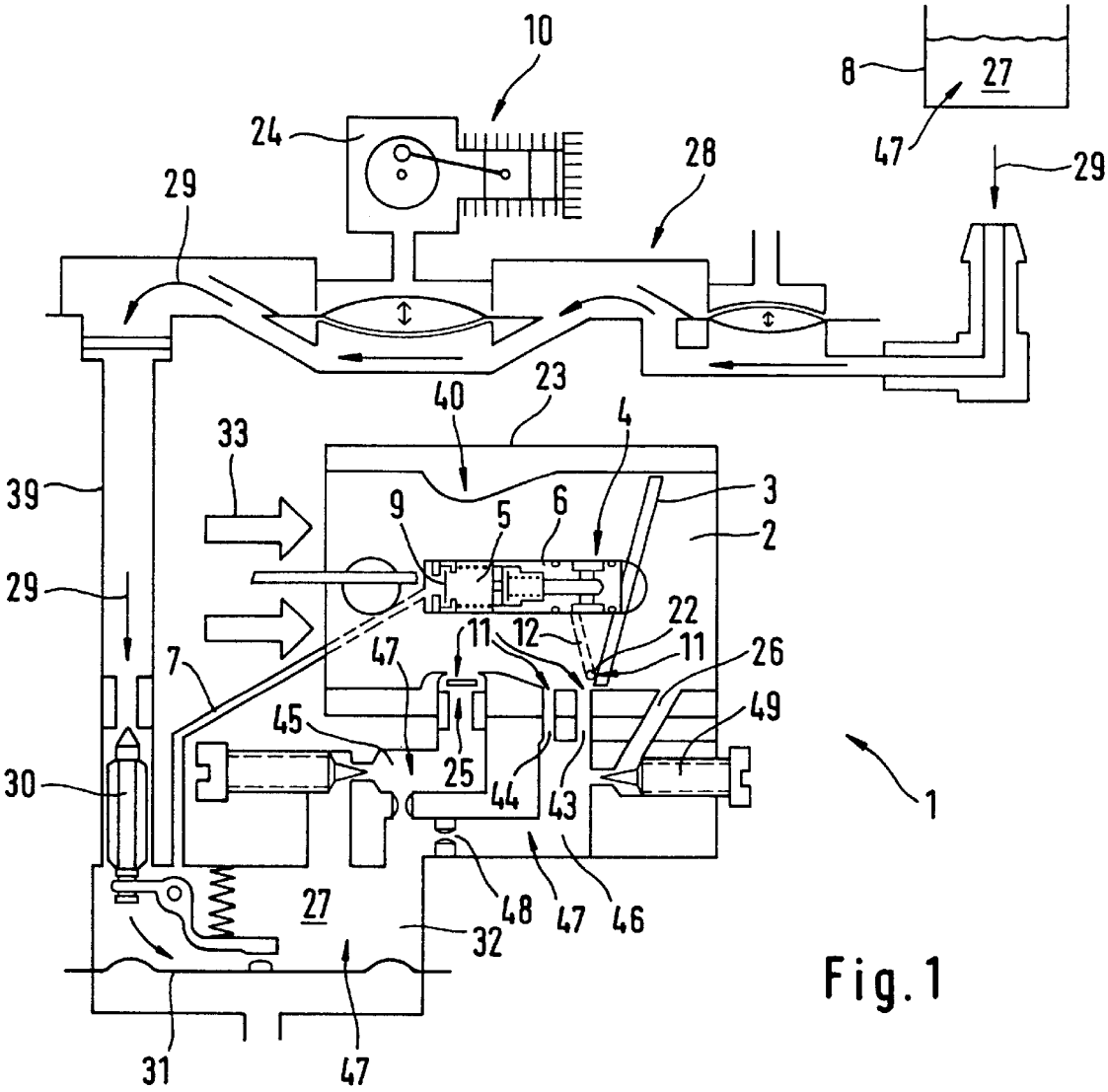
FIG. 1 is an illustration showing the principle of a diaphragm carburetor having an accelerator pump and pump line from the regulating chamber to the pump chamber.

The carburetor arrangement of the present invention comprises a butterfly valve that is pivotably mounted in the air channel that is in the carburetor and that leads to the internal combustion engine, and further includes an accelerator pump that is provided with a pump chamber and an accelerator piston that is guided in the pump chamber, with the accelerator piston being coupled with the butterfly valve; a first pressure-controlled check valve is disposed in a pump line via which the pump chamber is connectable with a supply of fuel.

By arranging a pressure-controlled check valve in the pump line that leads to the pump chamber, in the intake or suction phase of the accelerator pump the pump line is uncovered over the entire path of the accelerator piston. During an intake movement of the accelerator piston, a quantity of fuel can thereby be drawn into the pump chamber that at least nearly fills the entire stroke space of the accelerator pump. Relative to the size of the accelerator pump, there is thereby made available a large injectable quantity of fuel, so that in an inverse relationship to the structurally provided quantity of fuel that is to be injected, the accelerator pump can on the whole be kept compact. The pressure movement of the accelerator piston that generates the injection process leads already from the beginning to a closing of the check valve, so that no fuel for the injection process is lost due to fuel flowing back through the pump line. In this connection, the check valve is preferably disposed at an end face of the pump chamber, and is thereby subjected directly to the pressure in the pump chamber. This results in a reliable opening and closing of the check valve already at small pressure fluctuations. The arrangement of the check valve at the end face permits a simplified fabrication of the valve seat together with the pump chamber, as well as a simplified assembly.

Pursuant to one advantageous embodiment, a second pressure-controlled check valve is provided in an injection line that leads from the pump chamber to a fuel opening that opens out into the air channel. By means of this second check valve, a drawing-in of air through the fuel opening during the suction or intake movement of the accelerator piston is reliably avoided. Analogous to the described check valve in the pump line, there is effected during the alteration of the pump movement direction the opening and closing in a manner at least nearly free of loss. The alteration of the piston movement direction generates in the pump chamber, without a dead path, a pressure change, as a consequence of which the second check valve is closed over the entire intake path and is opened over the entire pressure path. As a consequence, at least nearly the entire quantity of fuel that corresponds to the stroke space of the accelerator pump can be injected through the injection line and the fuel opening into the air channel.

The second check valve is expediently disposed in the accelerator piston, as a result of which it is directly subjected to the pressure conditions in the pump chamber, and thereby sensitively and reliably opens and closes. The accelerator piston can be separately fabricated as an individual component with the integrated check valve. For the manufacture of a flow-conducting connection of a pump chamber to a fuel opening that is integral with the housing via the movable accelerator piston, the injection line has an opening on the peripheral side of the pump chamber. In correspondence with the position of the opening, there is provided on the accelerator piston a connection chamber that is embodied in particular as an annular groove and that overlaps the opening. The connection chamber overlaps the opening over the entire regulating distance of the accelerator piston, as a consequence of which the second check valve is in communication with the fuel opening independent of the position of the accelerator piston. The region of the second check valve in the accelerator piston thereby becomes a part of the injection line. As a consequence of this arrangement, the check valve, independently of the position of the piston, is permanently acted upon on one side with the pressure in the injection line, and on the opposite side with the pressure in the pump chamber. To avoid malfunctions, undefined pressure conditions on the check valve are reliably prevented.

The check valves expediently include a sealing seat and a valve reed that can rest against the sealing seat. Due to the flat shape of the valve reed, low pressure differences suffice for a reliable resting against or raising from the sealing seat. Only small regulating distances of the valve reed are required for the valve function, so that a rapid reaction time is provided.

Pursuant to one expedient embodiment, the accelerator piston is movable against the force of a compression spring via an eccentric disposed upon a butterfly valve shaft that supports the butterfly valve. While avoiding the complicated actuating mechanism, a direct actuation of the accelerator piston that is free of play is achieved, whereby a precise correlating movement of the accelerator piston is provided as a function of the position of the butterfly valve. During closing of the butterfly valve the compression spring generates an intake movement of the accelerator piston, so that the butterfly valve itself can be closed with a low actuating force, for example via a spring element.

The fuel opening for the injection of fuel via the accelerator pump is expediently a separate accelerator opening that opens into the air channel in the region of the butterfly valve. With such an arrangement, undesired reactive effects of the injection process upon the intake process as a consequence of the main and idling discharge openings are avoided. The accelerator opening is expediently disposed in the region of the butterfly valve, and in particular is disposed slightly upstream of the butterfly valve. An only slight actuation path of the butterfly valve guides the edges thereof past the accelerator opening, whereby the accelerator opening is disposed in the still only slight open gap between the butterfly valve and the wall of the air channel. In conjunction with the high air stream velocity that occurs at that location, an efficient accelerator injection is achieved already with an only slight opening of the butterfly valve. As a result, to achieve good exhaust gas values, the idling mixture can be set leaner, and yet with the lean idling setting an early enrichment of the mixture is achieved during the sudden opening of the butterfly valve.

The accelerator pump is expediently integrated in a housing of the carburetor, as a result of which on the whole a compact manner of construction is possible for the carburetor. Where the carburetor is a diaphragm carburetor, the pump line can be guided directly from the regulating chamber to the pump chamber, thereby avoiding the expense for additional line connections. As a consequence of the diaphragm, and a valve element that is controlled thereby, an adequate quantity of fuel for the accelerator injection is reliably and rapidly available. As a consequence of the regulating mechanism, the fuel supply has a precisely defined pressure level for constant injection conditions. Reciprocal effects, for example with the fuel supply in the region of the main discharge opening or the idling discharge bore, are avoided.

Further specific features of the present invention will be described in detail subsequently.

DESCRIPTION OF PREFERRED EMBODIMENTS

Referring now to the drawings in detail, FIG. 1, in an illustration of the inventive principle, shows a diaphragm carburetor 1 having an air channel 2 that leads to an internal combustion engine 10. A diaphragm pump 28 is connected in a pressure-conveying manner with a crankcase 24 of the internal combustion engine 10, and the pump is acted upon by the oscillating pressure of the engine for the delivery of fuel 27 from a fuel tank 8. The fuel tank 8 contains a supply 47 of fuel. The fuel 27 is conveyed over a fuel line 39, in the direction of the arrows 29, into a regulating chamber 32, where it also forms a supply 47 of fuel. The regulating chamber 32 is delimited by a diaphragm 31 that, as a function of pressure, acts upon a valve body 30 that is disposed in the fuel line 39. In the state of rest of the internal combustion engine 10, the fuel line 39 is closed by the valve body 30. During the operation of the internal combustion engine 10, in the air channel 2 the fuel 27 is drawn in out of the regulating chamber 32 through fuel openings 11. The thereby resulting pressure differential at the diaphragm 31 leads to an opening of the valve body 30 and hence to a flowing of fuel 27 into the regulating chamber 32.

To control the power of the internal combustion engine 10, there is provided in the air channel 2 a pivotably mounted butterfly valve 3 that is shown in the closed position for an idling operation of the internal combustion engine 10. In this position of the butterfly valve 3, overridingly a mixture of air and fuel 27 is drawn in through a fuel opening 11 that is embodied as an idling discharge bore 26. For this purpose, two further fuel openings 11 upstream in the vicinity of the butterfly valve 3 form a first and second bypass 43,44 through which air is drawn in out of the air channel 2. In a preceding emulsion chamber 46, this air is mixed with fuel 27 that flows in out of the regulating chamber 32 and through an idling nozzle 48; the mixture is discharged through the idling discharge bore 26 into the air channel 2. An idling screw 49 is provided for adjusting the quantity of flow.

Figure 2:
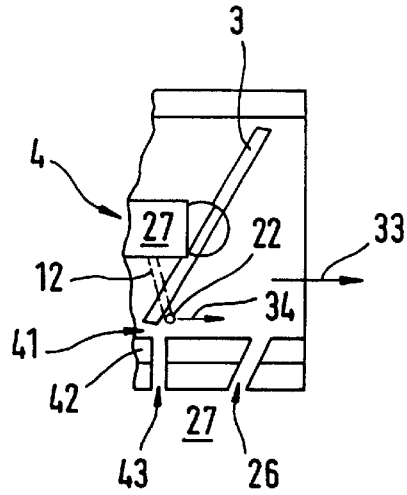
FIG. 2 shows a portion of the arrangement of FIG. 1 in the region of the accelerator nozzle, with the butterfly valve being in a slightly open state.

FIG. 2 shows the butterfly valve 3 in a slightly opened position, whereby the first bypass 43 is disposed downstream of the butterfly valve. In this way, air can now be drawn in only through the second bypass 44, and the emulsion that is formed is drawn into the air channel 2 through the idling discharge bore 26 and the first bypass 43. Upon further, non-illustrated opening of the butterfly valve 3, the second bypass 44 is also disposed downstream of the butterfly valve, as a consequence of which fuel 27 is also drawn in out of the emulsion chamber through such bypass. With the butterfly valve 3 in a fully opened position, the main quantity of the fuel 27 is drawn into the air channel 2 through a fuel opening 11 that pursuant to FIG. 1 is embodied as a main discharge opening 25. The underpressure necessary for this purpose in the air channel 2 is generated by guiding an intake air stream in the direction of the arrows 33 through a venturi section 40 that narrows the cross-section of the air channel 2.

Provided in a housing 23 of the carburetor 1 is an accelerator pump 4 having a pump chamber 5 and an accelerator piston 6 that is longitudinally displaceably guided in the pump chamber 5. The pump chamber 5 can in particular be connected via a separate line with the fuel supply 47, for example in the fuel tank 8 or in a main nozzle chamber 45 that precedes the main discharge opening 25. In the illustrated embodiment, the pump chamber 5 is connected with the regulating chamber 32 and the fuel supply 47 contained therein via a pump line 7 that is integrated into the housing 23 of the carburetor 1. Provided at an end face of the accelerator pump 4 is a check valve 9 that closes off the pump line 7; the check valve could also be disposed, for example, in the region of the regulating chamber 32. For the injection of fuel 27 into the air channel 2, an injection line 12 leads from the accelerator pump 4 to the air channel 2, and opens into the air channel 2 via a fuel opening 11 in the vicinity of the butterfly valve 3 that is embodied as a separate accelerator opening 22. Depending upon the application, the injection line 12 can also lead to one of the other fuel openings 11, for example the idling discharge bore 26 or to the main discharge opening 25. The accelerator opening 22 is disposed slightly upstream of the butterfly valve 3 relative to the direction of the air flow, which is indicated by the arrows 33.

The partial view of FIG. 2 shows the arrangement of FIG. 1 in the region of the accelerator opening 22. The butterfly valve 3 is shown in a slightly opened state, as a result of which the accelerator opening or nozzle 22 is disposed downstream of the butterfly valve 3, relative to the arrow 33. As a consequence of a gap 41 between the butterfly valve 3 and a wall 42 of the air channel 2, there results an underpressure by means of which the fuel 27 is drawn through the idling discharge bore 26 and the first bypass 43. In addition, fuel 27 is injected into the air channel 2 through the accelerator opening 22 and is carried along in the air channel 2 by the air stream approximately in the direction of the arrow 34.

Figure 3:
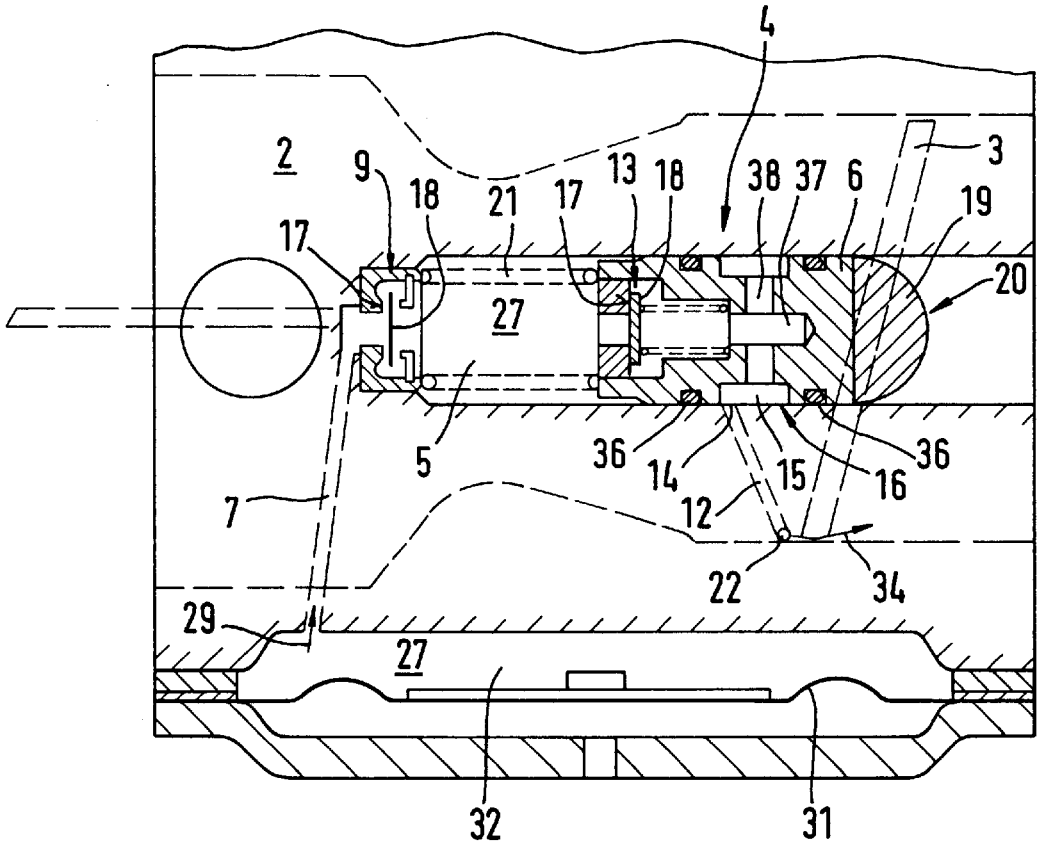
FIG. 3 is an enlarged view of the arrangement of FIG. 1 in the region of the accelerator pump, with the butterfly valve closed and the accelerator piston in a position of rest.

The enlarged, partial view of FIG. 3 shows the arrangement of FIG. 1 in the region of the accelerator pump 4 with the butterfly valve 3 in the closed idle position. The butterfly valve 3 is pivotably mounted about a butterfly valve shaft 20 via a semicircular eccentric 19. A flat surface of the accelerator piston 6 rests against the flat side of the eccentric 19 with bias via a compression spring 21. Disposed on that side of the accelerator pump 4 that is opposite the accelerator piston 6, at the end face of the pump chamber 5, is the first pressure-controlled check valve 9 which in the illustrated embodiment includes an annular sealing seat 17 that encircles the pump line 7, and a valve reed 18 that can rest against the sealing seat 17. As a consequence of a movement of the accelerator piston 6 from a position close to the valve in the direction of the illustrated position, fuel 27 is drawn out of the regulating chamber 32 in the direction of the arrow 29 through the first check valve 9 into the pump chamber 5. By means of the injection line 12, the pump chamber 5 can be connected with the accelerator opening 22 that opens into the air channel 2. A portion of the injection line 12 is disposed in the accelerator piston 6 and comprises an axial bore 37, a radial bore 38 that intersects the axial bore 37, and a connection chamber 16. In the illustrated embodiment, the connection chamber 16 is embodied as an annular groove 15 that surrounds the accelerator piston and in the axial direction is sealed at both sides by a respective O-ring 36 relative to the peripheral wall of the pump chamber 5. The annular groove 15 has a width that corresponds approximately to the regulating distance of the accelerator piston 6, whereby the annular groove 15, over the entire regulating distance of the accelerator piston 6, overlaps an opening 14 of the injection line 12 that leads into the pump chamber 5.

Provided in the axial bore 37 is a second, pressure-controlled check valve 13, which in the illustrated embodiment, in conformity with the first check valve 9, includes an angular sealing seat 17 and a valve reed 18 that can be pressed against the sealing seat 17. As a result of movement of the accelerator piston 6 from the illustrated position in the direction of the first check valve 9, there results in the pump chamber 5 a pressure by means of which the first check valve 9 is closed and the second check valve 13 is opened. The fuel 27 that is in the pump chamber 5 is injected by means of the injection line 12, with the second check valve 13 disposed therein, out of the accelerator opening 22 in the direction of the arrow 34 into the air channel 2.

Figure 4:
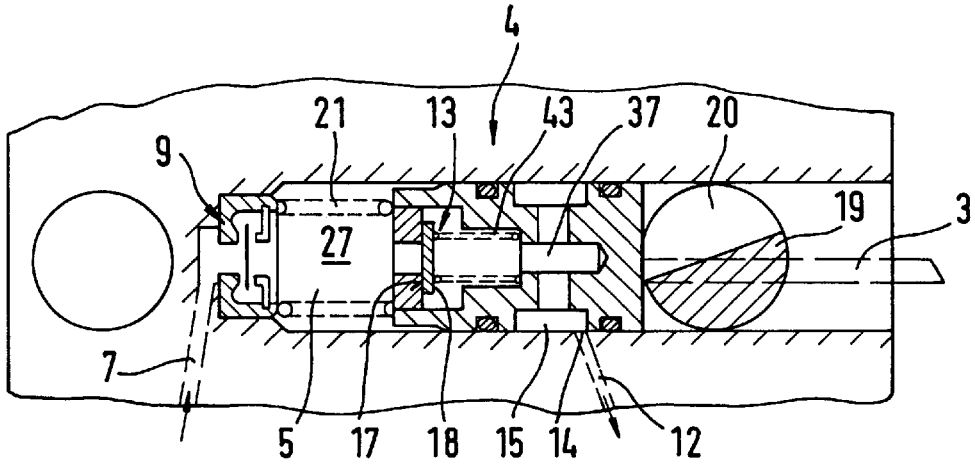
FIG. 4 shows a portion of the arrangement of FIG. 3 with the butterfly valve opened and the accelerator piston in its position after the injection process.

FIG. 4 shows the region of the accelerator pump 4 of FIG. 3, with the butterfly valve 3 in the open state. The butterfly valve shaft 20, with the eccentric 19, is rotated by about 70° relative to the position shown in FIG. 3, whereby the accelerator piston 6 is shifted by the eccentric 19 against the force of the compression spring 21 of the first check valve 9. Also in this position the annular groove 15 overlaps the opening 14 of the injection line 12. During closing of the butterfly valve 3 into the position shown in FIG. 3, the accelerator piston 6 is moved in the direction of the butterfly valve shaft 20 by the compression spring 21. As a result of the thereby accompanying increase in volume of the pump chamber 5 between the accelerator piston 6 and the first check valve 9, there results at that location an underpressure that leads to the closing of the second check valve 13 and the drawing-in of fuel 27 through the pump line 7. The pressure of the valve reed 18 against the valve seat 17 of the second check valve 13 is enhanced by a compression spring 43 that is disposed in the axial bore 37.

In the illustrated embodiment, the abutment surfaces of the eccentric 19 and of the accelerator piston 16 are planar. However, one or both abutment surfaces could also be convex and/or concave rounded portions, cams or cam disks. As a result, the kinematic connection between the position of the butterfly valve 3 and of the accelerator piston 6 is adjustable. For example, as a result, already with a slight opening movement of the butterfly valve 3, a large piston stroke having a correspondingly high injection quantity of fuel 27 can be achieved already at the beginning of the opening movement.

The specification incorporates by reference the disclosure of German priority document DE 201 07 670.5 filed May 5, 2001.

The present invention is, of course, in no way restricted to the specific disclosure of the specification and drawings, but also encompasses any modifications within the scope of the appended claims.

I claim:

1. A carburetor arrangement for an internal combustion engine of a manually-guided implement, comprising:

a carburetor, wherein an air channel that leads to said internal combustion engine is disposed in said carburetor;

a butterfly valve pivotably mounted in said air channel;

an accelerator pump that is provided with a pump chamber and an accelerator piston that is guided in said pump chamber, wherein said accelerator piston is coupled with said butterfly valve;

a separate pump line via which said pump chamber is connectable with a supply of fuel; and a first pressure-controlled check valve disposed in said pump line.

2. A carburetor arrangement according to claim 1, wherein said carburetor is a diaphragm carburetor.

3. A carburetor arrangement according to claim 2, wherein said diaphragm carburetor is provided with a regulating chamber that is delimited by a diaphragm, and wherein said pump chamber is connectable via said pump line with said regulating chamber.

4. A carburetor arrangement according to claim 1, wherein a butterfly valve shaft is provided for supporting said butterfly valve, wherein an eccentric is disposed on said butterfly valve, and wherein said accelerator piston is movable against the force of a compression spring via said eccentric.

5. A carburetor arrangement according to claim 1, wherein said accelerator pump is integrated into a housing of said carburetor.

6. A carburetor arrangement for an internal combustion engine of a manually-guided implement, comprising:

a carburetor, wherein an air channel that leads to said internal combustion engine is disposed in said carburetor;

a butterfly valve pivotably mounted in said air channel;

an accelerator pump that is provided with a pump chamber and an accelerator piston that is guided in said pump chamber, wherein said accelerator piston is coupled with said butterfly valve;

a pump line via which said pump chamber is connectable with a supply of fuel; and a first pressure-controlled check valve disposed in said pump line, wherein said check valve is disposed on an end face of said pump chamber.

7. A carburetor arrangement for an internal combustion engine of a manually-guided implement, comprising:

a carburetor, wherein an air channel that leads to said internal combustion engine is disposed in said carburetor;

a butterfly valve pivotably mounted in said air channel;

an accelerator pump that is provided with a pump chamber and an accelerator piston that is guided in said pump chamber, wherein said accelerator piston is coupled with said butterfly valve;

a pump line via which said pump chamber is connectable with a supply of fuel; and a first pressure-controlled check valve disposed in said pump line, wherein an injection line is provided, wherein said pump chamber is connectable via said injection line with a fuel opening that opens out into said air channel, and wherein a second pressure-controlled check valve is provided in said injection line.

8. A carburetor arrangement according to claim 7, wherein said second check valve is disposed in said accelerator piston.

9. A carburetor arrangement according to claim 7, wherein said injection line is provided with an opening on a peripheral side of said pump chamber, and wherein said accelerator piston is provided with a connection chamber that overlaps said opening and connects said second check valve with said opening in a flow-conducting manner.

10. A carburetor arrangement according to claim 9, wherein said connection chamber is embodied as an annular groove.

11. A carburetor arrangement according to claim 7, wherein at least one of said check valves includes a sealing seat and a valve reed that can rest against said sealing seat.

12. A carburetor arrangement according to claim 7, wherein said fuel opening is a separate accelerator opening that opens out into said air channel in the vicinity of said butterfly valve.

13. A carburetor arrangement according to claim 12, wherein said accelerator opening is disposed slightly upstream of said butterfly valve.

* * * * *